US008317183B2

(12) United States Patent
Brunschwiler

(10) Patent No.: US 8,317,183 B2
(45) Date of Patent: Nov. 27, 2012

(54) DEVICE AND PROCESS FOR TAKING OVER AND FURTHER PROCESSING OF FLEXIBLE, FLAT OBJECTS

(75) Inventor: Othmar Brunschwiler, Bettwiesen (CH)

(73) Assignee: FERAG AG, Hinwil (CH)

( * ) Notice: Subject to any disclaimer, the term of this patent is extended or adjusted under 35 U.S.C. 154(b) by 190 days.

(21) Appl. No.: 12/719,439

(22) Filed: Mar. 8, 2010

(65) Prior Publication Data

US 2010/0230888 A1 Sep. 16, 2010

(30) Foreign Application Priority Data

Mar. 10, 2009 (CH) ..... 358/09

(51) Int. Cl.
*B65H 29/40* (2006.01)

(52) U.S. Cl. ..... 270/52.25; 270/52.23; 270/52.19; 571/315

(58) Field of Classification Search ..... 270/52.14, 270/52.16, 52.19, 52.23, 52.25; 271/315
See application file for complete search history.

(56) References Cited

U.S. PATENT DOCUMENTS

| | | | | |
|---|---|---|---|---|
| 3,951,399 | A | 4/1976 | Reist | |
| 4,052,053 | A * | 10/1977 | Hasegawa et al. | 271/187 |
| 4,124,203 | A | 11/1978 | Muller | |
| 4,537,390 | A | 8/1985 | Kiamco et al. | |
| 4,723,770 | A * | 2/1988 | Seidel et al. | 270/52.2 |
| 5,065,994 | A * | 11/1991 | Hatt | 270/52.23 |
| 5,112,036 | A * | 5/1992 | Hatt | 270/52.23 |
| 6,095,511 | A * | 8/2000 | Jager | 270/52.29 |
| 6,234,466 | B1 * | 5/2001 | Infanger | 270/52.23 |
| 6,691,996 | B2 * | 2/2004 | Kaya et al. | 270/52.25 |
| 6,705,608 | B2 * | 3/2004 | Kish et al. | 271/206 |
| 6,830,241 | B1 * | 12/2004 | Klopfenstein | 270/52.25 |
| 7,571,902 | B2 * | 8/2009 | Carter et al. | 270/52.2 |
| 2007/0007722 | A1 | 1/2007 | Noll, Jr. et al. | |

FOREIGN PATENT DOCUMENTS

| | | |
|---|---|---|
| EP | 1 044 913 | 10/2000 |
| GB | 1003655 | 9/1965 |

* cited by examiner

*Primary Examiner* — Patrick Mackey
(74) *Attorney, Agent, or Firm* — Rankin, Hill & Clark LLP

(57) ABSTRACT

Receiver units (10, 90) for taking over objects (100, 101, 102) are moved past a take-over location (S1, S2) and include an abutment (95) which limits the position of the object (100, 101, 102) which is fed in the feed direction (F). At least one holding element and/or braking element (45) acts in a direct or indirect manner on the objects to be taken over, for realising a defined product position, in particular so that the object (100, 101, 102) does not bend up or rebound from the abutment (95). In one variant, the holding element and/or braking element (45) brakes the object (100, 101, 102) by way of direct friction. In another variant, the object (100, 101, 102) to be taken over transmits its momentum onto an object (100, 101, 102) which is already held in the receiver unit (10, 90) by way of the holding element and/or braking element, and is braked by way of this.

7 Claims, 4 Drawing Sheets a.)
b.)
c.)
d.)
e.)
f.)
$S_1$
$S_2$
b
F
10
12
13
14
15
16
17
30
32
40
41
42
43
101
101a
102
104 a.)
b.)
c.)
d.)
e.)
$S_2$
10
12
15
18
19
40
44
50
51
101
101a
102
104

DEVICE AND PROCESS FOR TAKING OVER AND FURTHER PROCESSING OF FLEXIBLE, FLAT OBJECTS

BACKGROUND OF THE INVENTION

1. Field of the Invention

The invention lies in the field of conveying and further processing flexible, two-dimensional (flat) objects, in particular printed products. It relates to a device and to a method for taking over and further processing such objects, in particular printed products such as e.g. newspapers, magazines, brochures, catalogues, part-products of such printed products, or supplements, brochures, CDs.

2. Description of Related Art

The further processing of printed products is carried out at ever increasing speeds. Moreover, more and more complex products are put together of several part-products and processed. Both of these, the high speeds and the complexity of the products, require a very accurate control of the product position at each point in time of the processing.

A process which occurs very often is the so-called insertion: one or more part-products (also called pre-products) are inserted into a folded outer product (also called main product). The part-products to be inserted may be printed products or also other objects, e.g. supplements, brochures, CDs.

The folded main product, for example, is transferred by a gripper conveyor to an insertion system, e.g. an insertion drum or a revolving system, before the insertion procedure. The insertion system has several receiver units in the form of pockets. The main products with the folded edge in front are inserted into these and are braked at the pocket base, acting as an abutment. The main product is subsequently opened and the further objects are inserted into the opened main product.

Moreover, from the CH application No. 00788/08 which has no prior publication, it is known to leave the folded main product in the gripper and to support it on the fold edge and on the side surfaces by way of co-moved abutments and additional support elements during the insertion procedure, i.e. for as long as the gripper needs to be opened for the purpose or receiving the further product.

With the known devices, the feed direction regularly runs in a different direction than the further conveying by the receiver units. For transfer, the singularised objects must be transferred into the moved receiver units within a very short time. For this reason, little space and time is available for the actual transfer. The objects are led with one edge in front, through an opening of the receiver unit, into this. Thereby, the objects are often subjected to very large (negative) accelerations and are stopped by a part of a receiver unit and aligned thereon. This part lying in the movement path of the fed objects, against which the leading edge runs, is hereinafter indicated as an abutment. The sudden braking at the abutment may lead to the newly fed object rebounding from the abutment and bouncing back opposite to the feed direction. Thereby, it may be laterally dislocated. If it consists of several objects, these may also mutually dislocate and/or rotate. The braking at the abutment may also lead to a bending-up or a sagging of the object depending on the flexibility or stability of the object. As a whole, too strong of braking at the abutment leads to undesired inaccuracies with regard to the position of the object. These may lead to errors in the further processing chain and should therefore be avoided.

BRIEF SUMMARY OF THE INVENTION

It is therefore the object of the invention to specify a device and a method for taking over and further processing flexible, two-dimensional objects, in particular printed products, with which the mentioned disadvantages are avoided and a good control of the object position is ensured, also during and after large accelerations.

The device according to the invention comprises at least one receiver unit, which is movable along a closed revolving path, and at a take-over location is capable of receiving an object, which is fed from a feed station at a feed speed. The receiver unit forms an abutment for the object to be taken over, which limits the movement of the object in the feed direction. According to the invention, at least one holding element and/or braking element is present, which is co-moved with the receiver unit. This element, at least in the region of the take-over location, is capable of acting on the object at least in an indirect manner, and of braking the object before reaching the abutment, i.e. of reducing its speed with respect to the feed speed.

In a first variant of the invention, the holding elements and/or braking elements cooperate directly with the object to be taken over and at least partly absorb its kinetic energy. The directed kinetic energy at least partly is converted into undirected movement energy (thermal energy, friction), i.e. at least partly dissipated. One prevents the object from rebounding or being dislocated in an uncontrolled manner by way of the large damping of the object in the receiver compartment. Moreover, one prevents the object from getting squashed, bending up or sagging in the receiver unit or on the abutment. The position of the object may therefore be well controlled.

In a second variant of the invention, the braking effect is based mainly on a momentum transmission. A folded product already held in the receiver compartment thus serves for receiving a further product to be taken over. It is preferably held such that its fold edge is distanced to the abutment. The holding element and/or braking element serve for this. It fixes the product in the compartment, but in a manner such that it may still be displaced by way of an external action, without becoming damaged. Then, the further product transmits its momentum partly onto the already held product, on insertion. Both objects move together with a reduced speed in the feed direction or in the direction of the abutment.

Both invention variants may also be combined. For example, with an insertion drum, a braking element may be applied with the first product (e.g. main product), which brakes the first product by way of friction. With the further product (e.g. pre-product) which is to be inserted, one may apply a simple holding element, which fixes the first product in the receiver unit, but permits displacements in the feed region and thus a braking of the second product by way of momentum transmission.

The invention may be realised on the basis of known take-over devices, in particular revolving systems or drum systems with several receiver compartments in the form of pockets, which are movable along an infinite or circular path. For example, the invention may be designed on the basis of pocket conveyors or gripper conveyors, insertion drums, cutting drums and likewise. The receiver units may be pockets or compartments of an insertion drum, which are moved individually along an infinitely shaped conveyor path. The holding elements and/or braking elements are preferably connected to the receiver units, and are co-moved by way of these. Several feed units and several take-over locations for a main product and pre-product(s) may be present for realising an insertion function, but the invention may also be advantageously applied with a simple transfer between two conveyors or with a simple processing, e.g. on cutting an object. A further processing in the context of the invention therefore includes also a simple conveying.

The feed unit may obtain objects from a storage means, e.g. a stack, a winding or from a moved formation, i.e. imbricate formation, a flow of individual products, gripper flow, etc. The fed objects may be simple objects, e.g. simple printed products or goods samples, or more complex collections, e.g. a small stack of different printed products lying on one another. The feed direction as a rule is in the plane of the object, and the conveyor direction of the receiver units runs perpendicularly thereto. The abutment, i.e. the pocket base, is orientated essentially perpendicularly to the feed direction and to the conveyor direction (surface normal in the feed direction).

The method according to the invention comprises the following steps: moving at least one receiver unit along a closed movement path, past a take-over location; receiving the objects by the at least one receiver unit; co-moving at least one holding element and/or braking element at least in the region of the take-over location with the receiver unit; braking the fed object at least partly and at least indirectly by way of the holding element and/or braking element. The product to be taken over is either braked in a direct manner by the braking element, or it is braked in an indirect manner, by way of it transmitting its momentum partly to an already taken-over product, which is stored in displaceable manner in the receiver unit by a holding element.

Preferably, the holding element and/or the braking element is adapted to the receiver unit, to the product and its feed speed, such that the leading edge only just reaches the abutment, in particular with a speed lying below a certain limit, which may also be zero. This is achieved in particular by way of a suitable selection of the shape, position and/or mechanical characteristics, such as e.g. friction coefficient elasticity, of the holding element and/or the braking element. As a whole, the object is aligned in a gentle manner on the abutment. However, it is also possible for the object not to reach the abutment and, thus, for the abutment to no longer act as an abutment in the conventional sense (the abutment function would be restored without holding element and/or braking element). A rebounding and bending-up/sagging are avoided in any case, and the alignment may basically be effected in a different manner.

The holding element and/or braking element acts preferably on one of the main surfaces of the object, and not on the edges in the manner of an abutment. With the first variant of the invention, with regard to the holding element and/or braking element, it is more the braking effect (dissipation of the kinetic energy) which is at the forefront. With the second variant of the invention, the holding element and/or braking element chiefly serves for fixing the already taken-over object in the receiver unit, so that this may absorb the momentum of the further object.

In both variants of the invention, the holding element and/or the braking element cooperates preferably with a support surface for the object or with a further holding element and/or braking element. The support surface may be part of the receiver unit or may be provided in addition to this.

The holding and/or braking element consists, for example, of a material which is elastic per se, e.g. is compressible and/or has a shape elasticity. It may be designed, for example, as a cushion-like loop of a thin elastic material, in particular of plastic. It may also be the case of one or more leaf springs. With the second variant of the invention, it may be the case of grippers.

The holding element and/or braking element is preferably designed in a surfaced manner, in order to load the object as homogeneously as possible, so as to brake an object by way of friction or hold it in the receiver unit. Preferably, theholding element and/or braking element has a region with a curved surface. For this reason, an entry gap for the object or a part region thereof, said gap in a lateral view tapering in a V-shaped manner, is formed with the interaction with a support surface which as a rule is plane, or with a suitably designed counter-holder element and/or braking element.

The holding element and/or braking element, above all for the first variant, preferably has a direction-dependent friction coefficient, by which means the friction in the feed direction, i.e. towards the abutment, is smaller than the friction opposite to the feed direction. A rebounding at the abutment or a bouncing-back of the object is additionally further prevented by way of this. The holding element and/or braking element, for example, has a surface with projections or bristles.

The holding element and/or braking element is preferably controllable in a direct or indirect manner, in order to vary the friction between the object and the holding element and/or braking element. By way of this, and depending on the demands for example, the object may, for example, be displaced in the receiver element or firmly clamped therein such that when another object hits, it may absorb its momentum.

A positioning device is preferably present for positioning the taken-over object in the receiver compartment. This, with the second invention variant for example, serves for bringing an already taken-over project into a position in which it is distanced to the abutment. With both variants, the positioning device is for example applied in order to bring the product into a defined position for the further processing, e.g. for cutting or further transport. For example, a defined position of the product relative to the receiver unit, i.e. a certain distance to the abutment, may be realised by way of the positioning device. In another example, the complete receiver unit may be displaced relative to a co-moved conveyor element, so that the product assumes a nominal position relative to the conveyor element and may be taken over and conveyed further by it, in a well controllable manner.

The positioning device preferably comprises a mechanical cam guide which acts on the product or on the conveyor compartments. The positioning device may also be realised by way of a suitable shape of the revolving path of the receiver compartments, e.g. in curved sections and/or sections with a hanging conveying, one may use the centrifugal force or gravitational force in a targeted manner for positioning, as the case may be with the interaction of further abutments and/or holding elements.

The principle according to the invention may be applied in all devices, with which products are fed to receiver units with a large speed and are thereby braked, thus for example on introducing products into pockets or opened products, e.g. insertion devices or cutting devices.

BRIEF DESCRIPTION OF THE DRAWINGS

Examples of the invention are represented in the drawings and are described hereinafter. There are shown in a purely schematic manner in.

DETAILED DESCRIPTION OF THE INVENTION

Figure 1:
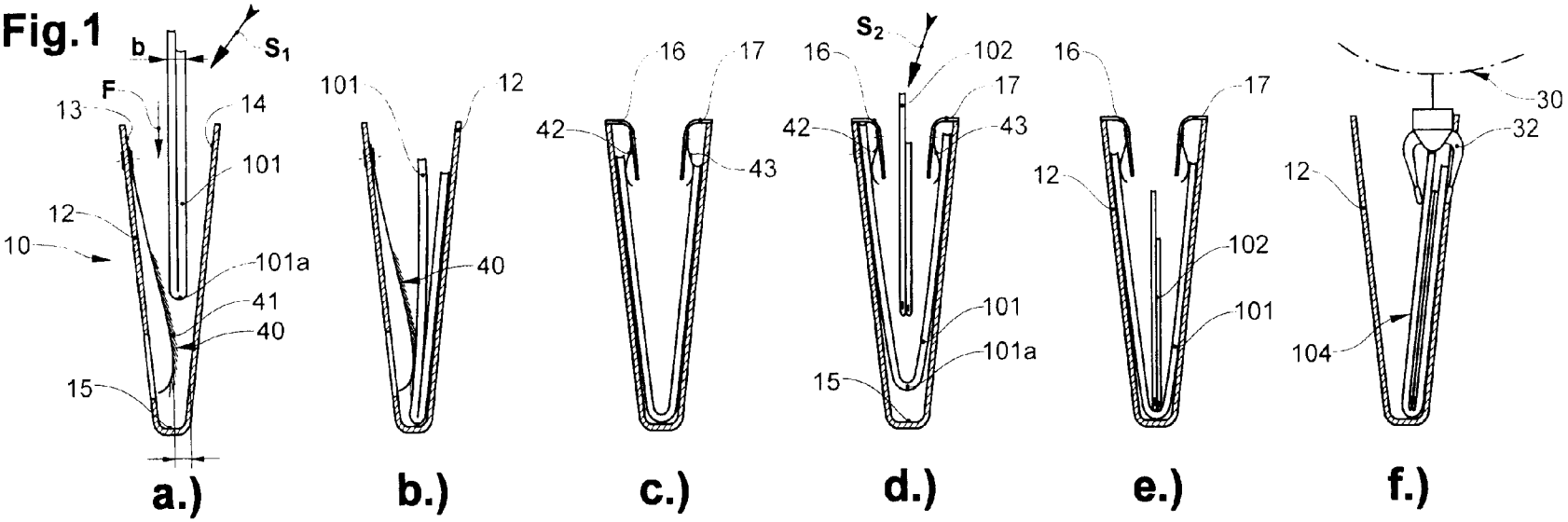
FIGS. 1*a-f* a receiver unit in the form of a pocket of an insertion system in different, sectioned views and temporally staggered representation.
FIG. 1*g* an overview representation of an insertion system.
Figure 1G:
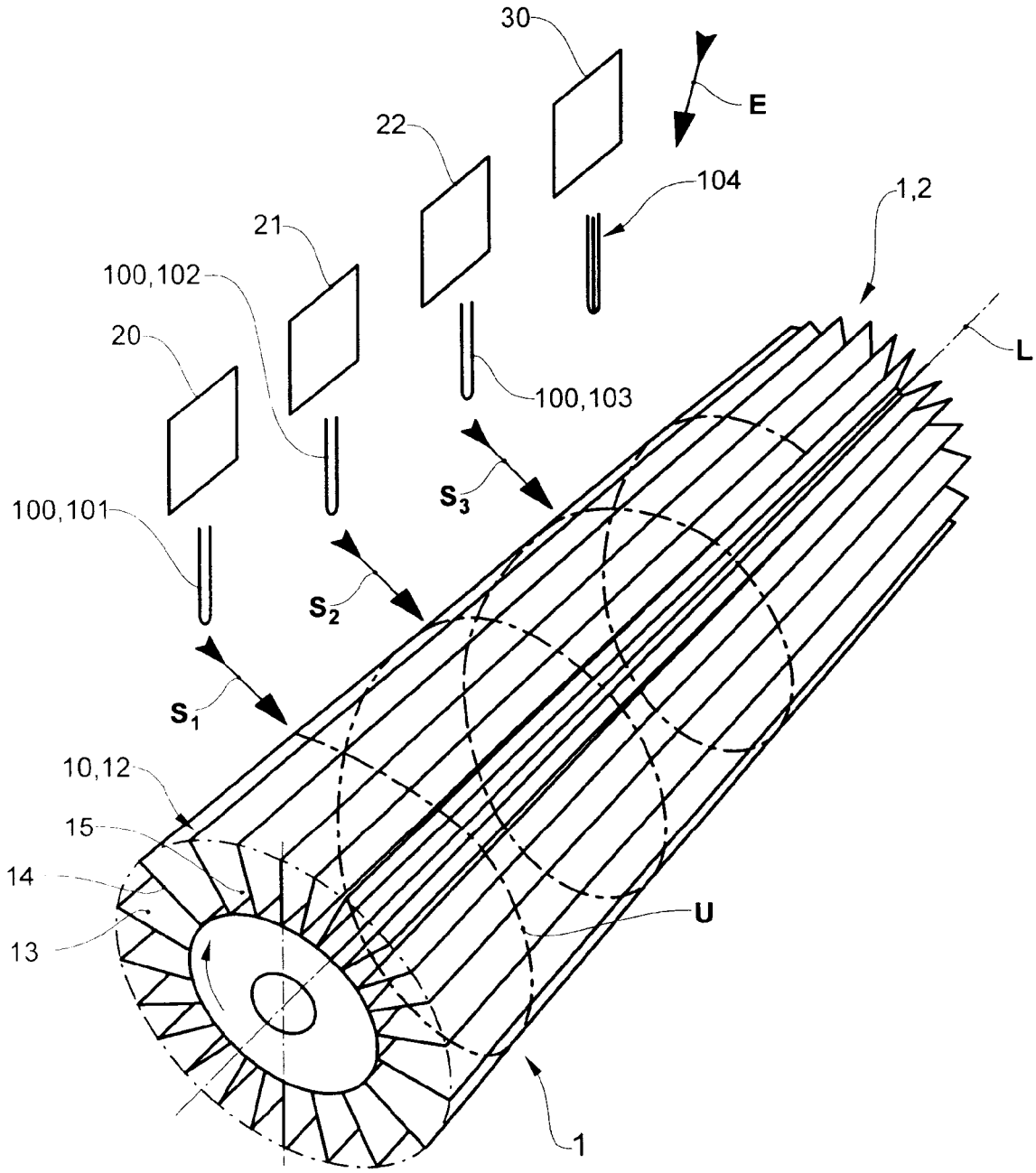
Figure 3:
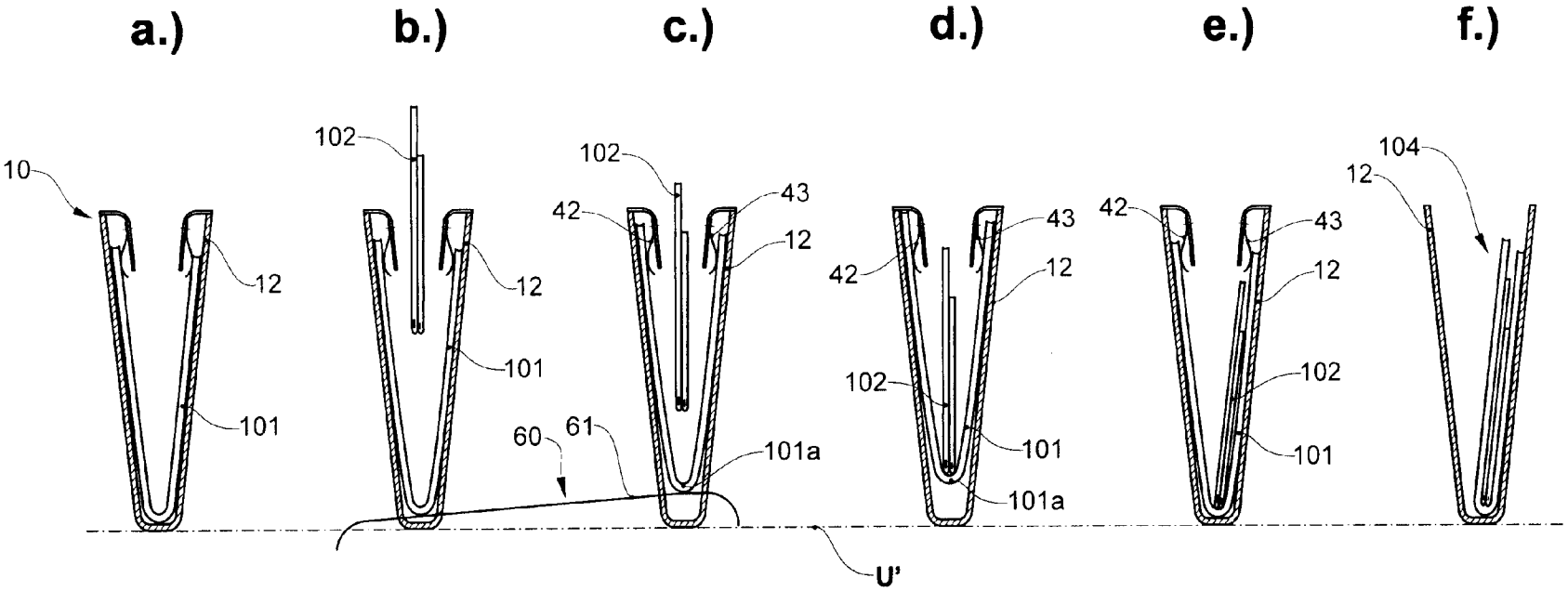
FIGS. 3*a-f* the positioning of the received objects by a positioning device with a pocket according to FIGS. 1*a-f* or 2*a-e;*

FIGS. 1*a-f* show the course of the method steps by way of a first example of a device according to the invention, on the basis of an insertion drum 2 which is known per se (see FIG. 1*g*). The insertion drum 2 is rotatable about a longitudinal axis L and has several receiver units 10 in the form of pockets 12. The pockets 12 have two support surfaces 13, 14 which are arranged V-shaped to one another, and a pocket base 15, which is aligned parallel to the longitudinal axis L and acts as an abutment. Objects 100, e.g. folded printed main products 101 or further folded or unfolded products 102, 103 are fed to the receiver units by way of different feed units 20, 21, 22, at defined take-over locations S1, S2, S2. These are arranged next to one another, but distanced to one another in the axial direction of the drum 2. The objects 100 are displaced in the direction of the longitudinal axis L by way of a displacement mechanism which is not shown in detail here, whilst the drum 2 rotates. They therefore describe a spiral path U about the longitudinal axis L. The main product 101, which is introduced firstly at the take-over location S1, goes past the take-over locations S2, S3 for the further products 102, 103 by way of the displacement and rotation of the drum. A complex collection 104 is created by way of insertion or lying on one another. This collection is removed at a removal station 30 and transported further, e.g. by way of a gripper conveyor.

Different section views of the pockets 12 perpendicular to the longitudinal axis L of the drum 2 are shown in FIGS. 1*a-f*. Opening functions or holding-open functions are realised by way of elements which are only present locally, such as e.g. the holding-open elements 16, 17 in FIG. 1*c-e*. The cross sections therefore differ from one another, and it is the case here of the same pocket 12. The views correspond to different stages during the insertion.

FIG. 1*a* shows the pocket 12 at the first take-over location S1. Here, the main product 101, with the fold edge 101*a* in front, is introduced into the pocket 12. A first holding element and/or braking element 40 is arranged within the pockets, along the drum section, in which the take-over location S1 is located. The holding element and/or braking element consists of a flexible material strip, which in the manner of a leaf spring is applied on one of the lateral support walls 12 in a cushion-like manner and is deformable relative to the support surface 13. It has a structured outer side 41 which here is provided with bristles directed towards the pocket base 15. The smallest distance d between the outer side 41 (including the bristles) and the oppositely lying support surface 14 is smaller than a typical product thickness b. By way of friction at the holding element and/or braking element 40, the introduced product 101 therefore at least partly gives its kinetic energy to this and the other support surface 14 and reaches the abutment 15 with a reduced speed. The product 101 is prevented from rebounding at the abutment and thereby being moved opposite to feed direction F, by way of the structured outer side 41. The product 101 therefore bears on the pocket base 15 after the introduction (FIG. 1*b*).

FIG. 1*c* shows the cross section after displacing the product 101 in the axial direction. An opening procedure has taken place. In the region shown here, two holding-open elements 16, 17 in the form of a bent guide plate are present, which in each case project into the pocket in a collar-like manner. The product 101 in the region of its two outer edges 101*b*, 101*c* is positioned behind the holding-open elements 16, 17. Two holding elements and/or braking elements 42, 43 are located on the sides of the holding-open elements 16, 17, which face the support surfaces 13, 14. These holding elements and/or braking elements likewise consist of a flexible material strip which is resilient against the respective holding-open element 16, 17. The product 101 is thus pressed in a resilient manner against the support surface 13, 14 in the region of its two outer edges 101*b*, 101*c*.

A positioning device which pushes the product 101 to the outside in the direction of the pocket opening (radial direction of the drum), is applied between FIGS. 1*c* and 1*d*. The positioning device for example comprises a stationary cam guide or revolving means, over which the fold edge 101*a* slides and which displaces the product 101 relative to the receiver compartment 10. Alternatively, one may also use the gravity for displacing the product 101, e.g. in the lower drum section. The fold 101*a* is therefore distanced from the abutment 15 within FIG. 1*d*. The second holding elements and/or braking elements 42, 43 serve for holding the product 101 in this position, thus open and distanced to the abutment.

The situation at the second feed location S2 is shown in FIG. 1*d*. A further product 102, here consisting of two part-products, is introduced into the pocket 12 or the opened main product 101. It hits the fold region of the main product 101 and by way of this pushes the main product 101 downwards (FIG. 1*e*). The product 102 is braked by way of the transmission of momentum onto the main product 101.

FIG. 1*f* shows the situation at the removal station 30, at which no holding-open elements 16, 17 and holding element and/or braking element 40, 42, 43 act. The inserted and closed product 104 is removed and conveyed further by way of grippers 32 for example. One may also carry out further feed steps according to FIGS. 1*c-e*, in front of the removal location 30.

FIGS. 2*a-e* show a further example of an insertion procedure as well as of the design of pockets 12, for example of an insertion system, e.g. of a drum or a revolving system. A transverse transport as with FIGS. 1*a-g* is not compelling, but is possible. The pockets comprise two support surfaces 13, 14 and a base 15, as with FIGS. 1*a-f*. A first holding element and/or braking element 40 in the form of a bent leaf spring with a structured outer surface 41 is attached on one of the support surfaces 13. The holding element and/or braking element 40 may pivot completely onto the support surface 13 through a recess 18 in the support surface 13, so that the pocket is completely opened and the holding element and/or braking element 40 becomes ineffective. This movement may be controlled in an active manner, here for example, by way of a cam guide (not shown), which cooperates with a control element 19 on the holding element and/or braking element 40. The strength of the friction and thus the braking effect may be set by way of this. The control element 19 is locked with the support surface 13 in FIGS. 2*b-e*.

Second holding elements and braking elements 50 in the form of small grippers are attached at the opening of the pocket 12 and may be pivoted into the pocket 12 in opposite directions. Again for example a (non-represented) cam guide serves for this, and cooperates with a control element 51 on the holding element and braking element 50. The holding elements and braking elements 50, on the one hand serve as holding-open elements, and on the other hand for fixing an already received product in the pocket 12, so that this may receive a further product and may brake it by way of momentum transmission. The function is explained hereinafter.

Figure 2:
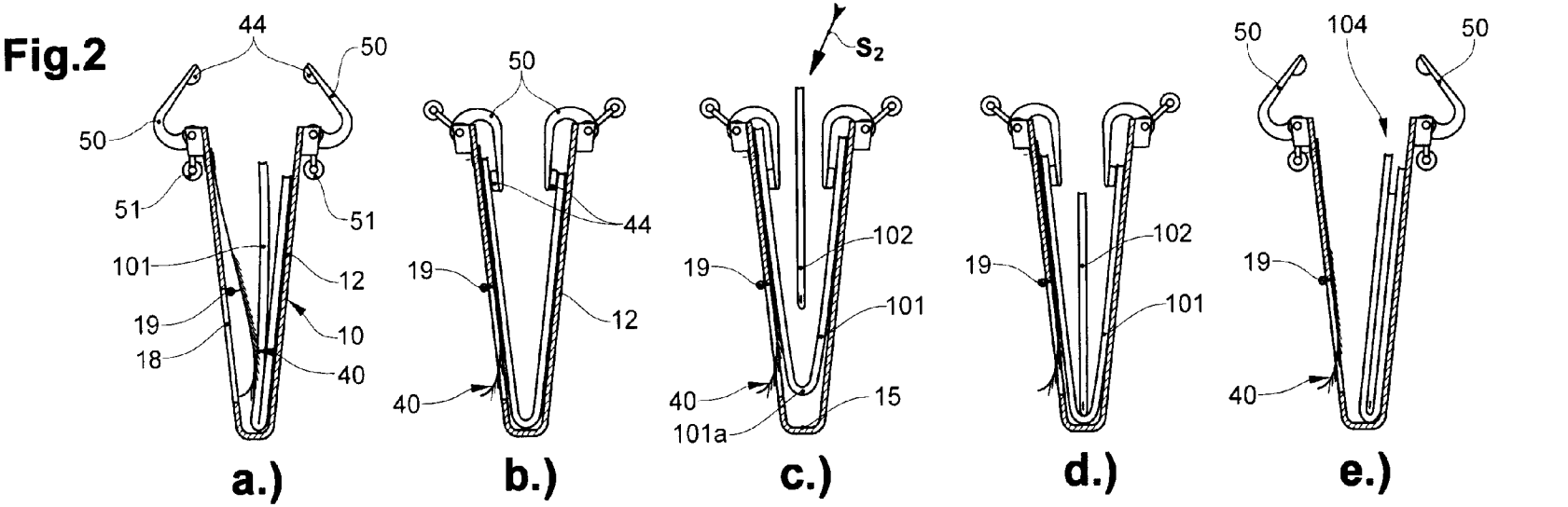
FIGS. 2*a-e* a further receiver unit in the form of a pocket of an insertion system, in various sectioned views and a temporally staggered representation.

A situation corresponding to FIG. 1*a* is shown in FIG. 2*a*. The feed direction F is directed to the drum 1. The first holding element and/or braking element 40 is pivoted into its active position, i.e. projects from the lateral support surface 13 and narrows the pocket 12 in the region close to the base. The product 101 was braked by the first holding element and/or braking element 40 and bears on the pocket base 15. The second holding elements and/or braking elements 50 are pivoted outwards and are ineffective. In FIG. 2*b*, the product 101 was opened and is held open by way of the second holding elements and/or braking elements 50 which are now pivoted inwards. The product is pressed slightly against the support surface 13, 14 by way of the second holding elements and/or braking elements 50, in particular their cushion-like flexible coatings 44. The first holding element and/or braking element 40 is pivoted into its inactive position. The product 101 is lifted from the compartment base between FIGS. 2*b* and 2*c*. For this, the clamping effect of the second holding element and/or braking element 50 is slightly reduced as the case may be. Now, in FIG. 2, a further product 102 is introduced, hits the folded main products 101 and catches this. Both products are moved further with a lower speed than the feed speed due to the momentum transmission, and hit the pocket base (FIG. 2*d*). A part of the kinetic energy which is transmitted onto the main product 101 dissipates on the second holding element and/or braking element 50. The product 104 may be removed (FIG. 2*e*) after the pivoting-away of the holding elements 50 and the closure of the inserted products 101, 102. Further insertion steps (displacement away from the abutment, fixation, insertion) may be carried out before the removal.

The following procedure is advantageous for putting together a more complex product, which consists of a folded main product and several further products with a different weight: Sequential insertion of the further products one after the other, instead of a one-off insertion of the package of the further products. With regard to the sequential insertion, it is firstly the lighter and then the heavier products which are to be inserted, because the heavier products have a greater momentum given the same feed speed, and are better braked by the already taken-over products, if these already have a larger mass.

FIGS. 3*a-f* show a possibility of how a positioning device 60 for the receiver units 10 according to FIGS. 1*a-f* may be designed. The movement path U' of the receiver units 10 is represented in an extended manner, but however may have any shape. The same principle may also be applied to compartments according to FIGS. 2*a-e*. It is the case of a simple guide cam 61 which has a guide surface and acts on the fold edges 101*a* in a certain region of the revolving path of the receiver units 10. The fold edges 101*a* slide on the guide surface of the cam 61 and by way of this are displaced relative to the pocket base 15. The products 101 for this project in the direction of the pocket base 15 beyond the receiver units 10, or the base 15 and the side surfaces 13, 15 have recesses (not shown here), into which the cam 61 engages, for example in a meshing manner. Revolving means, e.g. belts are also possible.

Figure 4:
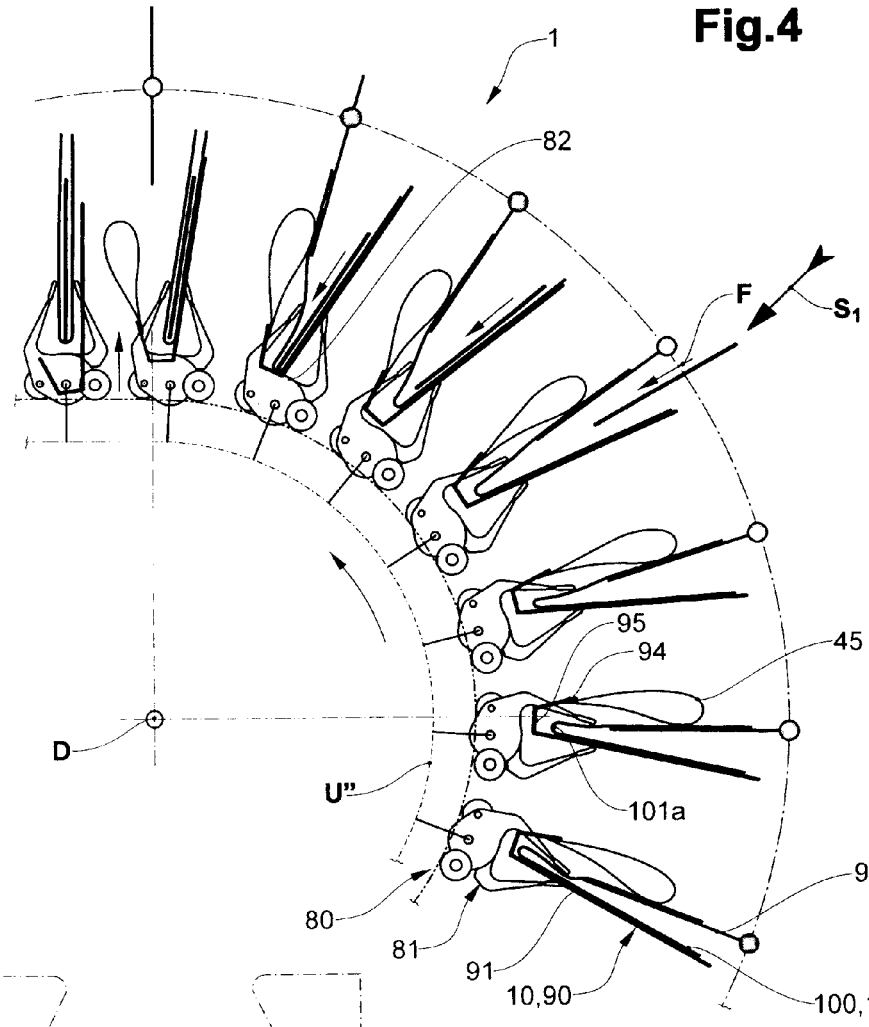
FIGS. 4 and 5 a further device according to the invention, with conveyor elements in the form of grippers and receiver compartments which are co-moved with these, with holding element and/or braking elements, in different views.
Figure 5:
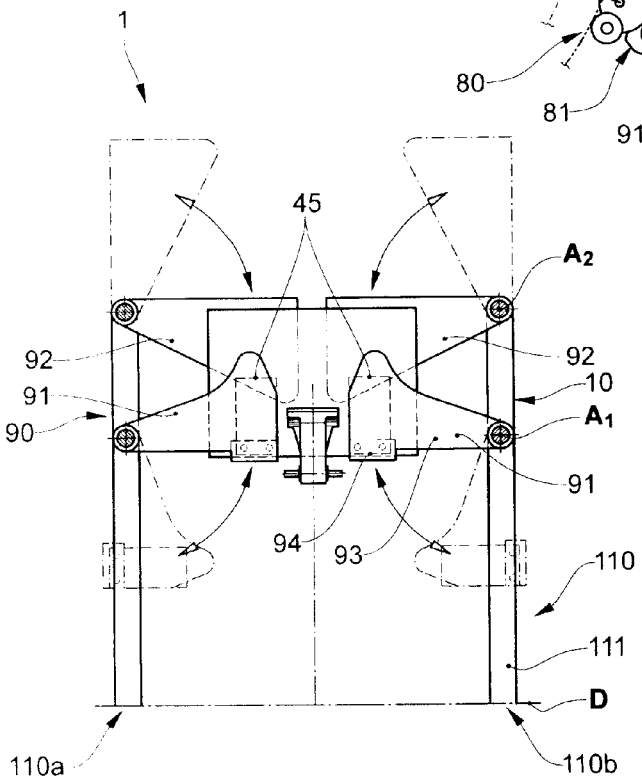
Figure 5:
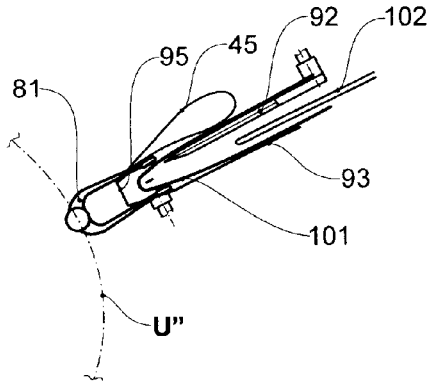

FIGS. 4 and 5 show a further example of a device with the holding element and/or braking elements according to the invention. The device corresponds essentially to the insertion device as has been described in the CH application No. 00788/08 which has no prior publication. The purpose of the insertion device is the insertion of products 102, which may be individual ones or also a composition of several products, into a folded main product 101. Thereby, the main products 101 are led up by way of a gripper conveyor 80. During the insertion procedure, the gripper 81 is opened, the product however not removed therefrom, but only additionally supported. The combined product after the insertion is conveyed further by the same gripper 81, which is then closed again.

The device here is only described in as much as this is necessary for the understanding of the invention on which this application is based.

The device comprises a plurality of receiver units 90, which are moved essentially along a circular path about a rotation axis D. The device is based on a drive wheel 110, which consists in each case of two part wheels 110*a*, 110*b*, in each case with a plurality of spokes 111. The part wheels 110*a*, 110*b* have a common axis, the rotation axis D, and are distanced to one another and designed in a roughly mirror-imaged manner. The receiver units 90 are formed by the interaction of several surfaced support elements 91, 92 which may be moved with respect to one another. In each case, two support elements 91, 92 are attached on the spokes 111, in each case of a part wheel 110*a*, 110*b*, and may be pivoted about axes A1, A2, which run perpendicularly to the spoke 111 (here perpendicularly to the drawing plane or in the peripheral direction of the wheel 110). The condition in which the support elements 91, 92 are in their active position and support a product, is shown in FIG. 5 by way of unbroken lines. The inactive position of the support elements 91, 92 is shown with dashed lines. The support elements 91, 92 in FIG. 4 are largely in their active position (in the anticlockwise direction from approx. "4 o'clock" to "1 o'clock") or are pivoted out of this ("1 o'clock" to "12 o'clock")

The support elements 91 arranged further inwards, in each case comprise a surfaced support wall 93 and a U-shaped element 94 at the end which is distant to the pivot axis A1. A receiver compartment 90 is realised in a temporary manner by way of the interaction of the two opposite support elements 91. A product 100 is supported by the bases of the U-shaped elements 94 and by the two support walls 93. An additional supporting function and holding-open function is achieved by the further support elements 92.

The inner support elements 91, furthermore, comprise a holding element and/or braking element 45 in the form of a loop of an elastic material. The loop may also be separated through at its apex point for increasing the flexibility. The holding elements and/or braking elements 45 are opposite the support wall 93 and are firmly connected to the U-shaped element 94.

The device according to the invention cooperates with a gripper conveyor 80. Its grippers 81 are moved along a closed revolving path U". This runs within the device 1 and in this region at least partly along a circular arc segment with the middle point D. The path of the grippers 81 is therefore at least partly parallel to the path of the receiver compartments 10, for example in the region represented in FIG. 4.

The function is explained hereinafter:

Products 100, here folded main products 101, are conveyed by the gripper conveyor 80. Whilst a product 101 is held by a gripper 81, the outer support elements 92 cooperating with one another run in between the product parts, in the lower part of the movement path U", which is not represented here. They therefore keep the product 101 open. The inner support elements 91 are pivoted in roughly simultaneously. The inner support elements 91 assume a position, in which their bases 95 have a defined distance to the gripped product edge 101*a* (situation approx at "3 o'clock"). The product 101 is opened in this position and the upper product part lies on the outer support elements 92. The holding elements and/or braking elements 45 press the upper product part against the outer support elements 92. The gripper 81 is opened. The gripper 81, receiver units 10 and the product 101 in this relative position are moved synchronously by about 45° up to the take-over location S1 (at approx. "2 o'clock"). A further product 102 is inserted in the feed direction F, which runs perpendicularly to the base 95 and to the movement direction of the receiver units 10. It pulls the product 101, which is already arranged in the receiver unit 10 and the open gripper 81, inwards. The new product 102 is braked by way of momentum transmission and to a lesser extent by way of friction between the holding element and/or braking element 45, the leading product part and the support element 92. The fold edges of both products 101, 102 now come to bear on the base 95 acting as an abutment (at approx. "1 o'clock").

The base 95, and thus the fold edge 101*a*, here are located above the lowest point 82 of the gripper 81. This position does not necessarily correspond to the nominal position of the edge 101*a* to be gripped, relative to the gripper 81. The products 101 are positioned again in a correct manner to the gripper 81 by way of cam-controlled lifting of the inner support elements 91 relative to the gripper 81 (between "2 o'clock" and "1 o'clock"). The gripper 81 is subsequently closed. The support elements 91, 92 which are now no longer necessary for supporting, are pivoted away to the top or to the bottom, so that the gripper conveyor 80 may be led out of the inner region between the two part wheels 110*a*, 110*b*.

The invention claimed is:

1. A device for taking over and further processing flexible, flat objects, at a take-over location from a feed unit, comprising:

at least one receiver unit which is moved along a closed revolving path, which is capable of receiving an object at the take-over location and forms an abutment for the object to be taken over, and at least one holding element and/or braking element which is co-moved with the receiver unit and which is capable, at least in the region of the take-over location, of acting on the object at least in an indirect manner and of decelerating the object before reaching the abutment, a plurality of conveyor elements in the form of grippers, which are movable along a closed gripper conveyor path and which are designed to receive a folded object in a clamping manner;

a control device, in the form of a cam control, which is designed in order to open the grippers at an opening location lying in front of the take-over location in the movement direction, and to close them at a closure location lying behind the take-over location;

wherein the at least one receiver unit is a plurality of receiver units, which are movable along a closed receiver unit revolving path and form an abutment and a support surface for the fold edge or one of the side surfaces of the folded printed object, wherein the receiver units are movable synchronously with the grippers, at least in the region of the take-over location, in a manner such that objects arranged in the grippers are positioned in the receiver units; and wherein the at least one holding element and/or braking element is a plurality of holding elements and/or braking elements which are assigned to the receiver units and are co-moved with these and are capable of pressing one of the objects against the receiver unit, so that the folded object forms a receiver for a further objectand is spaced from the abutment, wherein the further object is decelerated by way of momentum transmission to the open, folded object.

2. A device according to claim 1, further comprising a positioning device which is capable of displacing the receiver unit downstream of the take-over location relative to the assigned gripper, in a direction running perpendicular to the gripper revolving path.

3. A method for taking over and further processing flexible, flat objects, comprising the following steps:

moving at least one receiver unit, which forms an abutment for the object to be taken over, along a closed movement path past a take-over location;

receiving the objects by way of the at least one receiver unit;

co-moving at least one holding element and/or braking element with the receiver unit, at least in the region of the take-over location;

decelerating the fed object at least partly and at least in an indirect manner by way of the holding element and/or braking element, before the object reaches the abutment;

the fed object reaching an abutment.

4. A method according to claim 3, wherein the object is decelerated by way of direct contact with the holding element and/or braking element and that the kinetic energy of the object is at least partly dissipated.

5. A method according to claim 3, wherein an object to be taken-over anew is introduced into an already taken-over, folded object and is decelerated by way of momentum transmission to the already taken-over, folded object.

6. A method according to claim 3, further comprising the following steps:

introducing a folded object into the receiver compartment and holding the folded object by way of the holding element and/or braking element, in a manner such that it forms a receiver for a further object to be taken over;

introducing a further object to be taken over, into the already taken-over, folded object, with a feed speed;

momentum transmission from the object to be taken over to the already taken-over object and, by way of this, the common displacement of both objects in the receiver unit with a speed which is reduced with respect to the feed speed.

7. A method according to claim 3, wherein the position of the taken-over object relative to the receiver unit and/or relative to a co-moved conveyor element is adapted to a nominal position, in order to bring the object into a defined position for the further processing.

* * * * *